US008770426B2

(12) United States Patent
Arnett et al.

(10) Patent No.: US 8,770,426 B2
(45) Date of Patent: Jul. 8, 2014

(54) SHOCK-RESISTANT AND ENVIRONMENTALLY SEALED CONTAINER

(76) Inventors: Jeffrey D. Arnett, Fallbrook, CA (US); Matthew P. Thomas, La Mesa, CA (US); Alan K. Uke, Del Mar, CA (US)

( * ) Notice: Subject to any disclaimer, the term of this patent is extended or adjusted under 35 U.S.C. 154(b) by 898 days.

(21) Appl. No.: 12/952,185

(22) Filed: Nov. 22, 2010

(65) Prior Publication Data

US 2011/0084075 A1 Apr. 14, 2011

Related U.S. Application Data

(63) Continuation of application No. 11/540,284, filed on Sep. 29, 2006, now Pat. No. 7,837,053, which is a continuation-in-part of application No. 09/689,001, filed on Oct. 12, 2000, now abandoned.

(51) Int. Cl.
*B65D 45/02* (2006.01)

(52) U.S. Cl.
USPC ..... 220/326; 220/834; 292/116

(58) Field of Classification Search
USPC ..... 220/326, 324, 833, 834; 292/113, 116, 292/247
See application file for complete search history.

(56) References Cited

U.S. PATENT DOCUMENTS

| | | | | |
|---|---|---|---|---|
| 2,626,010 | A | 1/1953 | Sebok | |
| 2,743,029 | A | 4/1956 | Mautner | |
| 2,939,603 | A | 6/1960 | Young | |
| 3,464,579 | A | 9/1969 | Asenbauer | |
| 3,709,538 | A | 1/1973 | Seitz et al. | |
| 4,109,819 | A | 8/1978 | Kushman et al. | |
| 4,111,476 | A | 9/1978 | Jacobs | |
| 4,818,502 | A | 4/1989 | Taschner | |
| 4,838,586 | A | 6/1989 | Henne | |
| 4,861,078 | A | 8/1989 | Munoz | |
| 4,934,019 | A * | 6/1990 | Shorthill et al. | 15/327.2 |
| 5,234,124 | A | 8/1993 | Buckner, III et al. | |
| 5,257,839 | A | 11/1993 | Nielsen et al. | |
| 5,577,779 | A | 11/1996 | Dangel | |
| 5,735,428 | A | 4/1998 | Chern | |
| 6,955,381 | B2 * | 10/2005 | Parker et al. | 292/113 |
| 7,568,739 | B2 * | 8/2009 | Lee | 292/80 |
| 2002/0162841 | A1 * | 11/2002 | Shamir et al. | 220/326 |

* cited by examiner

*Primary Examiner* — Stephen Castellano
(74) *Attorney, Agent, or Firm* — Daniel M. Chambers; Acuity Law Group, P.C.

(57) ABSTRACT

A shock-resistant and environmentally sealed container comprising a first section and a second section. A latching system for the container comprises a deflectable pin coupled to the first section of the container with a latch coupled to the second section. The latch includes a deflectable pin engaging member. When the deflectable pin engaging member is engaged with the deflectable pin, the deflectable pin absorbs relative movement between the first section and the second section of the container. Another embodiment of the container employs a latch containing a deflectable member. The latch is pivotally coupled to a latch pin that is mounted to either the first section or the second section of the container. The deflectable member is positioned between the latch pin and the latch, and the deflectable member is configured to absorb relative movement between the first section and the second section.

10 Claims, 15 Drawing Sheets

SHOCK-RESISTANT AND ENVIRONMENTALLY SEALED CONTAINER

CROSS-REFERENCE TO RELATED PATENT APPLICATIONS

This application is a continuation of U.S. patent application Ser. No. 11/540,284, filed on Sep. 29, 2006, issued as U.S. Pat. No. 7,837,053, which is a continuation-in-part of U.S. patent application Ser. No. 09/689,001, filed on Oct. 12, 2000, which is now abandoned, the contents of which are herein incorporated by reference in their entirety for any and all purposes.

FIELD OF INVENTION

The present invention generally related to containers. More particularly, the invention concerns containers that are both shock-resistant and environmentally sealed.

BACKGROUND OF THE INVENTION

A wide variety of containers are used everyday to transport the goods that comprise the modern global economy. An ever-increasing part of the new economy are electronic devices such as digital cameras, personal digital assistants, and other apparatus. However, containers that were previously suitable for transporting mechanical goods are not capable of safely shipping the delicate electronic devices of today. Moreover, the technology employed by the transport industry has not kept pace with the goods it transports. For example, shipping containers continue to be dropped by careless handlers and good shipped overseas are subject to a host of adverse environmental conditions.

In response, electronics and other manufacturers are demanding new containers that can survive drop tests and pressure tests, that are aimed at protecting their products from high humidity, moisture and the severe impacts that can occur during shipment.

However, the new containers have several shortcomings. For instance, containers designed to be airtight and waterproof employ a sealing ring to seal the container. When the container is closed, the sealing ring is partially compressed. However, upon impact, the seal compresses completely, which allows the latches to loosen, resulting in a container that opens unexpectedly. In addition, the severe impact tests also destroy container hinges which cause the containers to break apart. Additional problems include damage to handles, latches and other components located on the exterior of the containers.

Therefore, a need exists for a shock-resistant, environmentally sealed container that can transport delicate goods while enduring rigorous shipping conditions.

SUMMARY OF THE INVENTION

In order to overcome the deficiencies with known, conventional containers, a shock-resistant and environmentally, sealed container is provided. Briefly, the container provides a number of latching systems that keep the container closed even after severe impacts.

More specifically, one embodiment of the present invention container employs a deflectable pin coupled to one section of the container and a latch coupled to a second section of the container. The latch includes a deflectable pin engaging member and when the deflectable pin engaging member is engaged with the deflectable pin, the latch system absorbs relative movement between the first section and the second section of the container. Another embodiment of the present invention employs a latch pin mounted on a first container section and a latch containing a deflectable member mounted in the latch with the latch pivotally coupled to the latch pin so that the deflectable member is positioned between the latch pin and the latch. The latch is structured to removably engage a second container section and the deflectable member is configured to absorb relative movement between the first section and the second section of the container.

The shock-resistant and environmentally sealed container of the present invention affords its users with a number of distinct advantages. First, unlike prior containers, the latches remain secured even after severe impacts. In addition, a plurality of ribs extending around the container protect the handles, latches and the top and bottom sections of the container from severe impact. In addition, a removable hinge pin is included which permits the two sections comprising the container to be completely separated from each other. This modification can be accomplished by hand, without the use of any tools.

BRIEF DESCRIPTION OF THE DRAWINGS

The nature, goals, and advantages of the invention will become more apparent to those skilled in the art after considering the following detailed description when read in connection with the accompanying drawing in which like reference numerals identify like elements throughout wherein.

It will be recognized that some or all of the Figures are schematic representations for purposes of illustration and do not necessarily depict the actual relative sizes or locations of the elements shown.

DETAILED DESCRIPTION OF THE INVENTION

In the following paragraphs, the present invention will be described in detail by way of example with reference to the attached drawings. Throughout this description, the preferred embodiment and examples shown should be considered as exemplars, rather than as limitations on the present invention.

Figure 1:
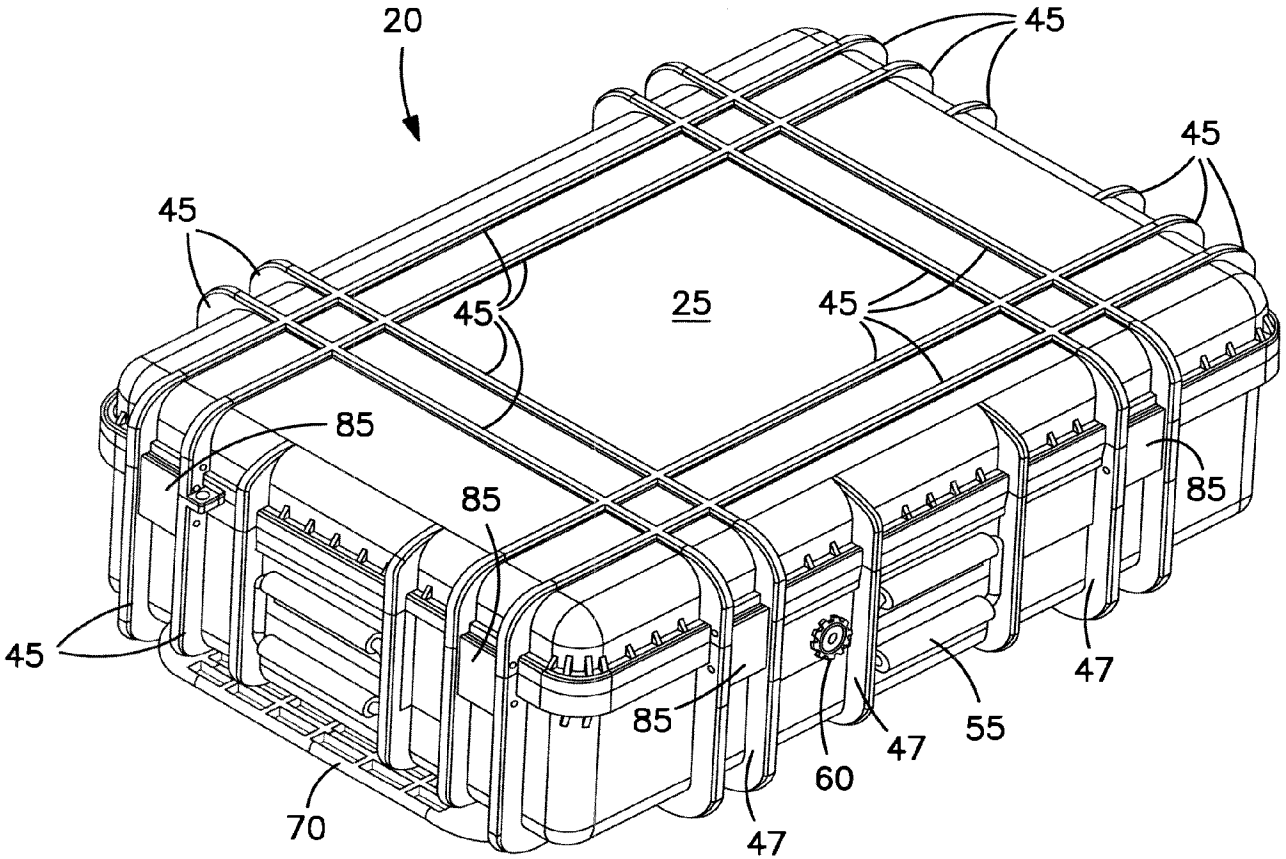
FIG. 1 is a perspective view of one embodiment of the shock-resistant and environmentally sealed container.
Figure 2:
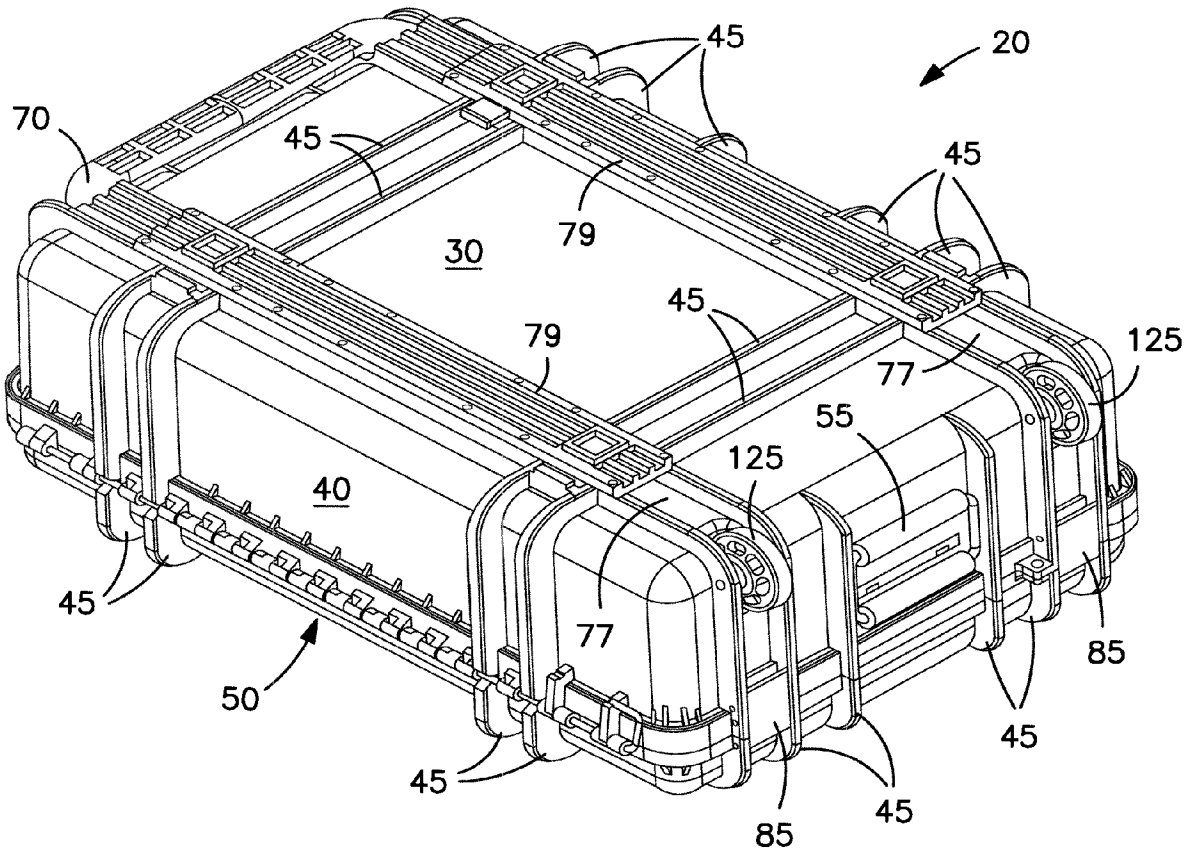
FIG. 2 is a perspective view of the embodiment of FIG. 1 showing the bottom of the container.

Referring to FIGS. 1 and 2, a shock-resistant and environmentally sealed container 20 in accordance with the present invention is illustrated. The container 20 generally comprises a substantially rectangular receptacle for holding delicate or fragile objects. The container 20 is shock-resistant and is configured to absorb substantial impacts. The container 20 is also environmentally sealed and therefore is waterproof and airtight. As used herein, waterproof means the container 20 is impervious to water and therefore does not permit entry of water into the container 20. In addition, as used herein airtight means the container is impermeable by air, therefore air cannot enter the container 20 when it is closed. The container 20 incorporates several unique features that permit it to securely transport delicate and fragile object without the risk of opening as result of mishandling or inadvertent accidents.

FIGS. 1-4 illustrate a container 20 having a top or first section 25 and a bottom or second section 30. The container 20 is substantially rectangular, but it will be appreciated that other container shapes, such as squares or more elongated rectangles, may also be constructed using principles according to the present invention. In the illustrated embodiment, eight ribs 45 extend around the outer surface of the container 20. Additional rib portions 45 also extend along the sides of the container 45. For example, illustrated in FIG. 3 the front side 35 has six rib portions 45. Shown in FIG. 4, the hinge side 40 of the container 20 has four rib portions 45. It will be appreciated that the number of ribs 45 can vary depending upon the strength requirements and aesthetic requirement of the container 20. In a preferred embodiment, the ribs are molded integrally into the first and second sections 25 and 30, respectively. The container 20, including ribs 45, is injection-molded using acrylonitrile-butadiene-styrene (ABS). It will be appreciated that other types of plastics or other composite materials can be used to manufacture the container 20. Ribs 45 add structural strength to the container by increasing the bending and torsional stiffness of the container 20. In addition, as illustrated in FIGS. 1 and 2, the ribs extend past the latches 85, handles 55 and other objects positioned on the outside of the container 20, thereby protecting the objects from damage.

Figure 3:
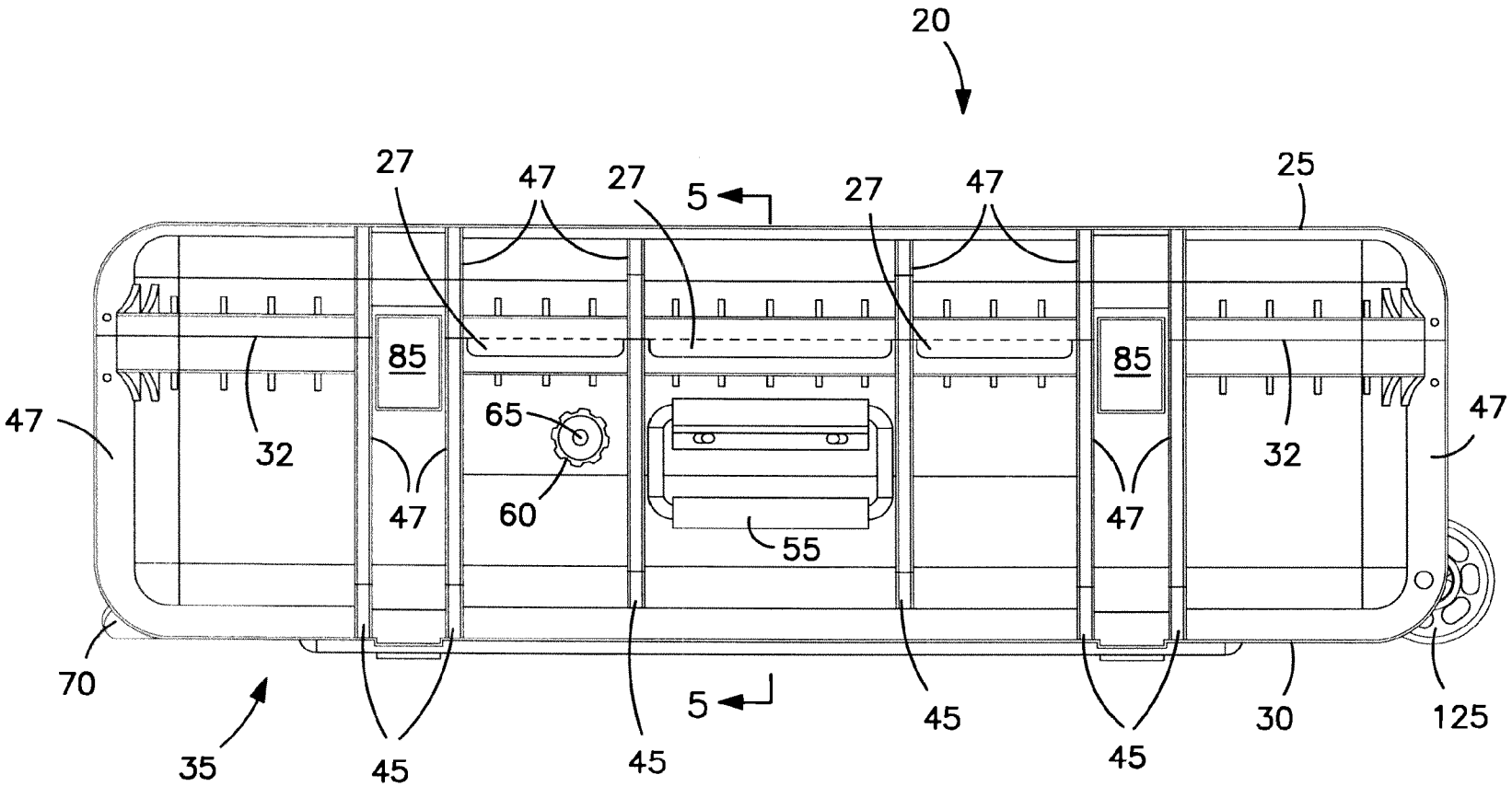
FIG. 3 is an elevation view of a front side of the container illustrated in FIG. 1.
Figure 5:
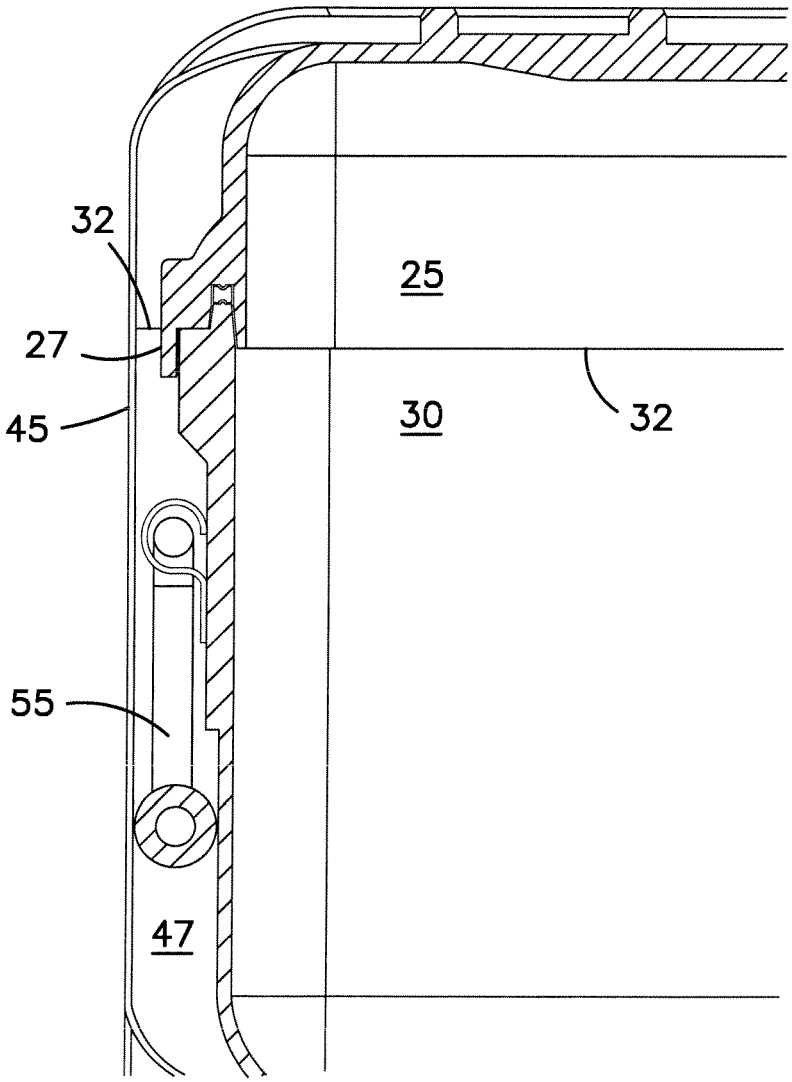
FIG. 5 is a sectional view taken along cutting plane 5-5 of FIG. 3.
Figure 6:
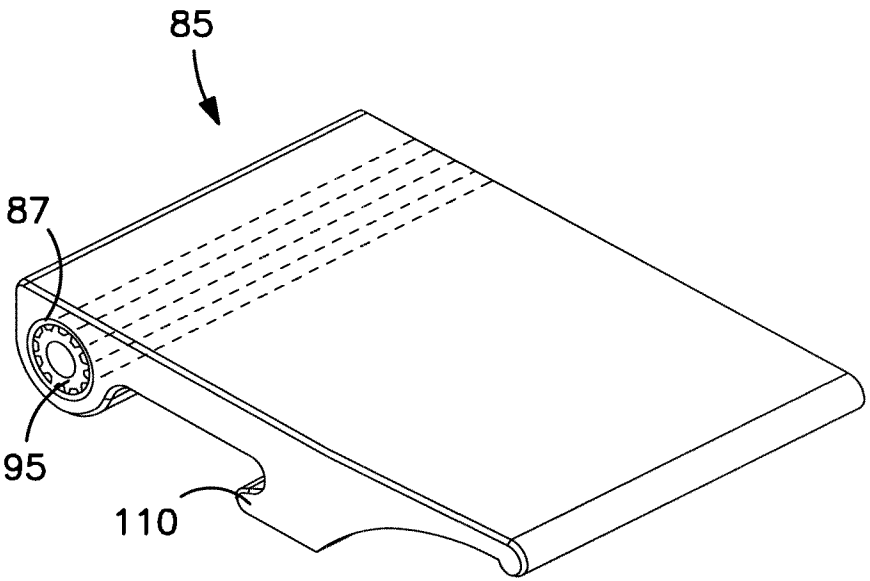
FIG. 6 is a perspective view of one embodiment of a latch used to secure the container illustrated in FIG. 1.
Figure 7:
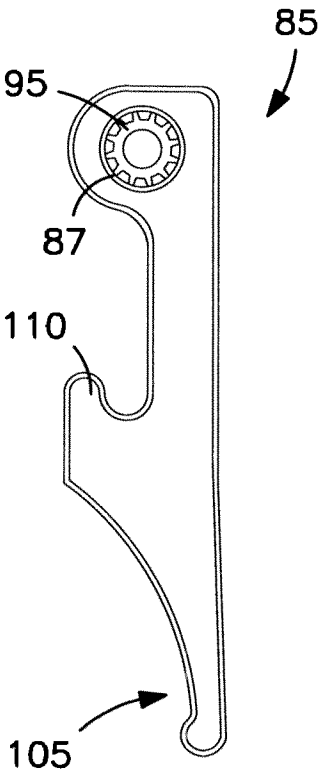
FIG. 7 is an elevation view of the latch illustrated in FIG. 6.

Referring now to FIGS. 3 and 5, the ribs 45 in conjunction with overlapping tabs 27 keep the first section 25 from being torn-off or otherwise removed from the second section 30 during impacts. Overlapping tabs 27 are connected to the first section 25 and overlap over the second section 30. Shown in FIG. 5, parting line 32 defines the meeting point of first section 25 and second section 30. Overlapping tab 27 extends over the parting line 32 from the first section 25 over the second section 30. Referring now to FIG. 3, the overlapping tabs 27 closely abut the rib sides 47. The distance between the rib sides 47 and the overlapping tabs 27 can range from about 0.01 inches to about 0.1 inches. When the container 20 is dropped or otherwise mishandled and encounters a force on load on the first section 25, that load is transferred to the second section 30 through the overlapping tabs and into the ribs sides 47. In this manner, the rib sides 47 support the first section 25 and keep the first section 25 from deflecting relative to the second section 30. This ensures that the first section 25 remains securely attached to the second section 30 thereby keeping the container 20 environmentally sealed even under severe impact loads.

Referring now to FIGS. 6-9, a latch 85 constructed in accordance with the present invention is illustrated. Latch 85 includes a bushing 95 located in a cylindrical cavity 87 of latch 85. One embodiment of the bushing 95 comprises a cylindrically-shaped bushing having an outer surface comprised of a series of projections running along the longitudinal-axis of the bushing 95. It will be appreciated that other versions of the bushing 95 could be employed such as one or more bushings positioned within the cylindrical cavity 87 of the latch 85. Bushing 95 has a central aperture extending along its longitudinal axis which is sized to receive a latch pin 100, shown in FIGS. 8 and 9. In one embodiment, latch pin 100 is mounted in first section 25, but it will be appreciated that the latch pin 100 could be mounted in the bottom section 30. Latch 85 is pivotally coupled to the first section 25 by the latch pin 100 which is inserted through the bushing 95. When the container 20 is closed, latch 85 can be rotated about the latch pin 100 so that latch locking ridge 110 fictionally engages the container locking ridge 115, shown in FIG. 8. In this manner, the two container sections 25 and 30 are securely held together. When desired, the container 20 can be opened by pulling on the finger grip 105 and releasing the latch 85 from the container locking ridge 115 and pivoting the latch 85 about the latch pin 100. Advantageously, latch pin 100 is mounted in a double-shear arrangement in ribs 45, resulting in an extremely strong and durable latch 85 mount.

Figure 8:
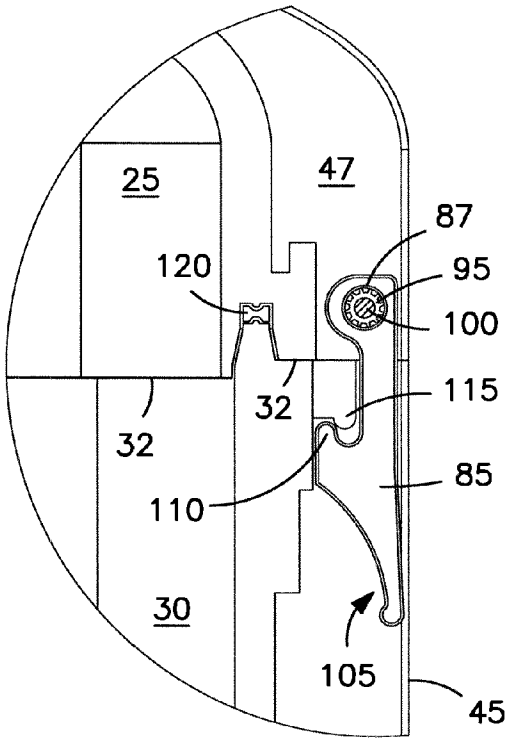
FIG. 8 is a side elevation sectional view of the latch illustrated in FIG. 6 attached to the container illustrated in FIG. 1.
Figure 9:
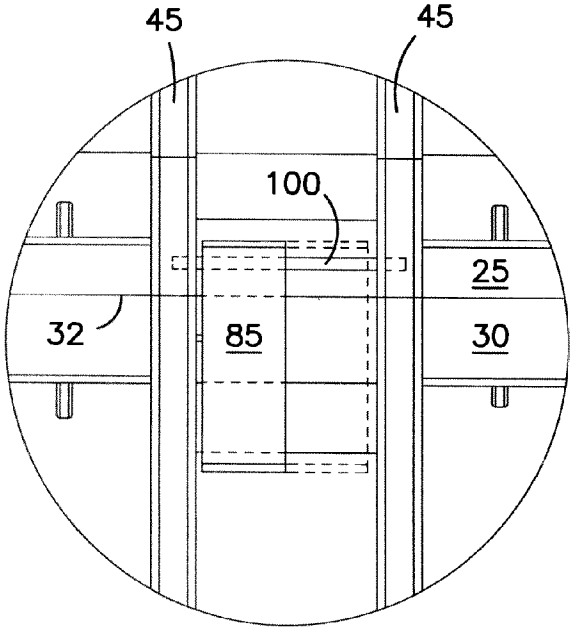
FIG. 9 is an elevation view of the latch and surrounding area illustrated in FIG. 8.

Referring now to FIG. 8, gasket 120 is positioned between the first section 25 and the second section 30 of the container 20. In one embodiment the gasket 120 resides in a recessed channel in the first section 25, but it will be appreciated that the gasket 120 can also be located in the second section 30. Gasket 120 creates an airtight and waterproof seal by sealing the first section 25 to the second section 30. In a preferred embodiment gasket 120 is made of a soft rubber or plastic material and has a substantially D-shape with a hollow center section. However, it will be appreciated that solid gasket or gaskets of other configurations such as O-rings can be employed.

Referring now to FIG. 8, one advantage of the present invention is illustrated. When a force or load is exerted against the top section 25 of the container 20, such as when the container 20 is dropped, the top section 25 presses against the bottom section 30, compressing gasket 120. Latch pin 100, which is also connected to first section 25 compresses bushing 95 as the top section 25 is forced against the bottom section 30. In contrast to conventional latch systems that are rigidly mounted, and that would release and allow the container 20 to open, the latch system of the present invention can absorb the load and keep the latch 85 securely engaged. This is because bushing 95 deflects, as shown in FIG. 8, allowing the latch pin 100 to shift in the cylindrical aperture 87 of the latch 85. Because the bushing 95 deflects, the latch 85 does not move keeping the latch 85 securely engaged with the second section 30 of the container 20. Another advantage of the present invention is that the bushing 95 frictionally engages the latch pin 100, creating a rotational resistance in latch 85. Because latch 85 does not freely rotate about latch pin 100, when the latch 85 is released and the container 20 is opened the latch 85 remains in an open position keeping the finger grip 105 from contacting the parting line 32 when the container 20 is closed.

Figure 10:
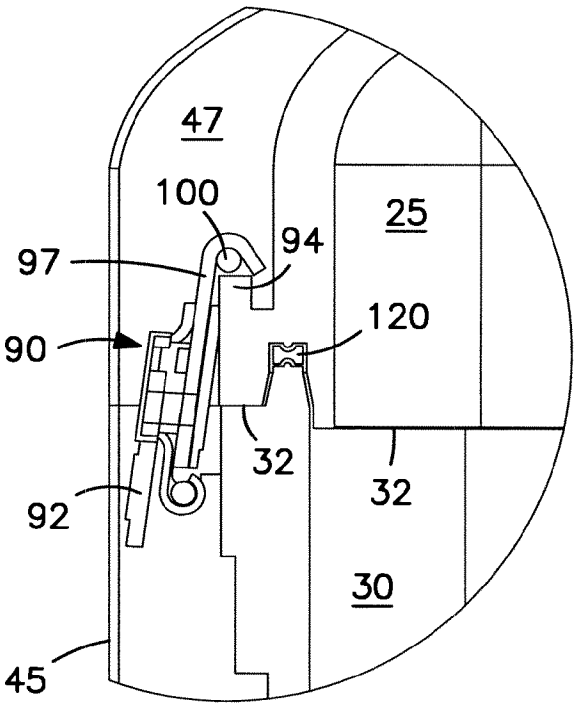
FIG. 10 is a side elevation sectional view of an alternative embodiment latch that secures the container illustrated in FIG. 1.
Figure 11:
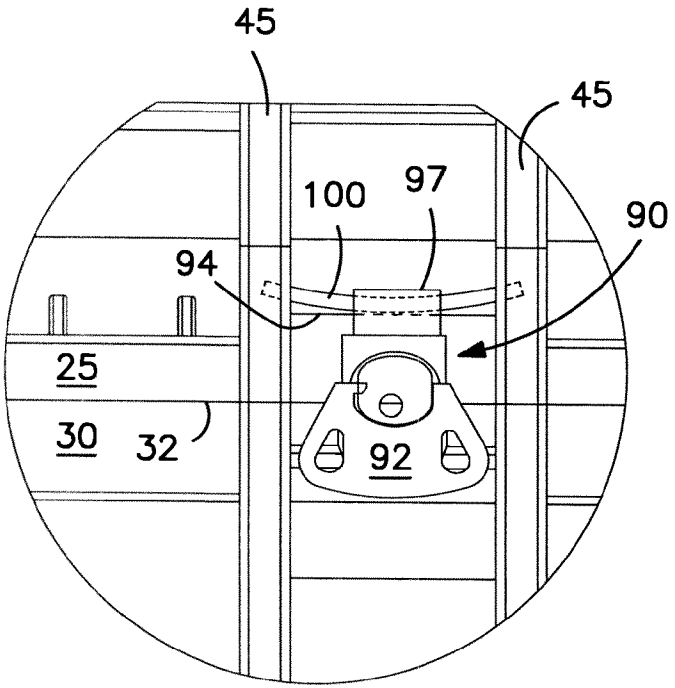
FIG. 11 is an elevation view of the latch illustrated in FIG. 10.

Referring now to FIGS. 10-11, an alternative embodiment latching system in accordance with the present invention is illustrated. In this embodiment, military latch 90 is employed to secure the first section 25 of the container 20 to the second section 30. The military latch 90 is a conventional latch used for military applications and meets military specifications. The military latch 90 employs a twist tab 92 that pulls pin engaging member 97 downward into the latch 90 when the twist tab 92 is twisted by an operator. In this manner the first section 25 is firmly held against the second section 30, tightly sealing the container 20. However, the military latch 90 is comprised of several individual elements and each element has its own manufacturing tolerance. During assembly these elements having different tolerances, or dimensions, are combined creating military latches 90 having different sizes. For example, the pin engaging member 97 may be slightly longer than another pin engaging member 97 and twist tab 92 may not pull in the engaging member 97 as far as military latch 90 as another military latch 90, hereby creating a clamping difference between military latches 90. One advantage of the present invention is the use of a latch pin 100 that deflects, thereby absorbing the manufacturing tolerances of the military latch 90. Illustrated in FIG. 11, latch pin 100 is engaged by the pin engaging member 97 and when twist tab 92 is rotated by an operator the latch pin 100 deflects, closing the container 20. The deflection of the latch pin 100 absorbs the manufacturing tolerances in contrast to prior latching systems that permitted the military latch 90 to release inadvertently during shipment. In addition, the latch pin 100 absorbs the compression of the gasket 120 when the container 20 encounters impacts or loads. As discussed above, the gasket 120 can compress during severe impacts causing the first section 25 and second sections 30 to compress together creating slack in the military latches 90. The deflectable latch pin 100 absorbs this slack keeping the military latch 90 secured about the latch pin 100 and keeping the container 20 closed. Also shown in FIGS. 10-11 is deflectable pin stop 94. The deflectable pin stop 94 acts as a support or deflection limiting member to the deflectable latch pin 100. When severe impacts are encountered by the container 20, the first section 25 and the second section 30 can move relative to each other causing the latch pin 100 to deflect. Under extreme impacts, the deflectable latch pin 100 may deflect to the point where pin engaging member 97 disengages from the deflectable latch pin 100, allowing the container 20 to open. With the deflectable pin stop 94 positioned adjacent to the deflectable latch pin 100, the total amount of deflection of the latch pin 100 is limited. Limiting. the deflection of the latch pin 100 keeps the pin engaging member 97 of the military latch 90 firmly engaged with the latch pin 100 even under extreme impacts. As shown in FIG. 11, when a load is encountered, the latch pin 100 deflects contacting deflectable pin stop 94, thereby limiting the deflection of the latch pin 100 and ensuring that the pin engaging member 97 remains attached to the deflectable latch pin 100. Preferably, latch pin 100 is made of tempered spring-steel. It will be appreciated that other types of materials can be used to make latch pin 100 so that it can deflect and spring back into position. In one embodiment latch pin 100 is about 0.175 inches in diameter, and can be easily replaced by pushing the latch pin 100 through ribs 45.

Advantageously, container 20, constructed according to the present invention, can accept either the military latch 90 or the latch 85, without change to the structure of the container 20.

Figure 4:
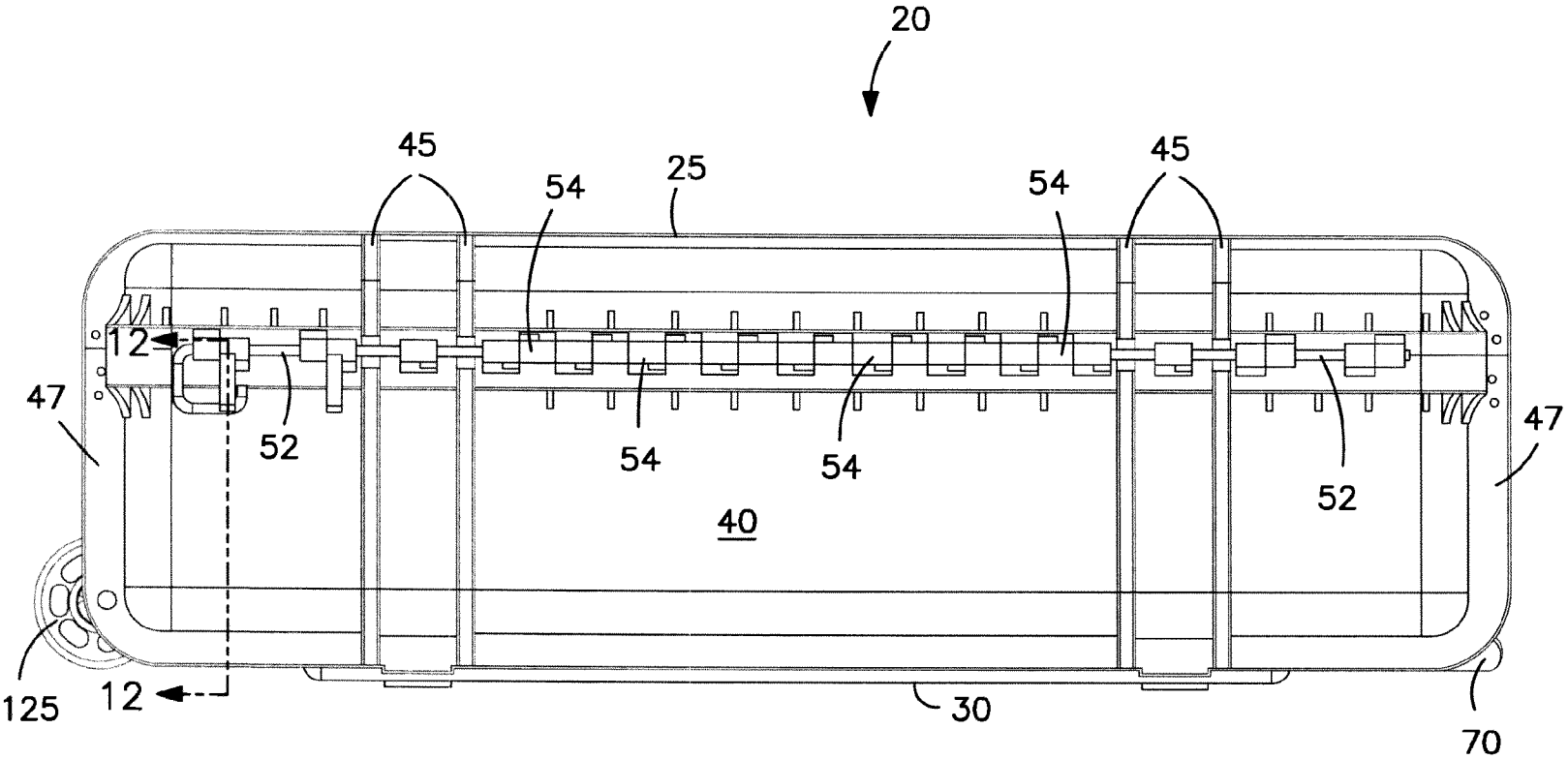
FIG. 4 is an elevation view of the hinge side of the container illustrated in FIG. 1.

Referring now to FIGS. 2 and 4, a hinge 50 constructed in accordance with the present invention is illustrated. The hinge comprises an elongated rod 52 that is positioned in a plurality of rod receivers 54. The rod receivers 54 are alternatively mounted on the first section 25 and on the second section 30 and are sized to slideably receive the elongated rod 52. One advantage of the present invention is that elongated rod 52 can be easily removed from the rod receivers 54 thereby allowing the first section 25 to be completely separated from second section 30. In this manner, the individual sections can be used to carry the contents of the container 20 or the separate sections can be separated for efficient storage.

Figure 12:
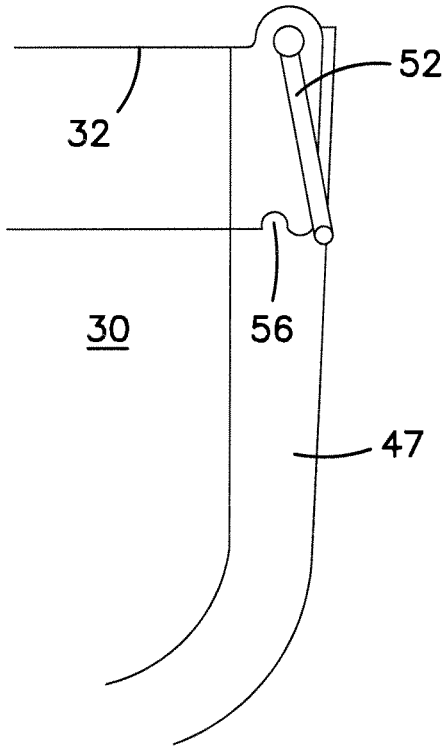
FIG. 12 is a sectional view taken along cutting plane 12-12 of FIG. 4.

Referring now to FIG. 12, locking means for securing the elongated rod 52 to the second section 30 are illustrated. A rod detent 56 is located on the second section 30 of the container 20 and when the elongated rod 52 is inserted into all of the rod receivers 54 the elongated rod end is pivoted so that it engages the rod detent 56 securely. Advantageously, inserting the elongated rod 52 into the rod detent 56 can be performed by hand, yet the arrangement permits the elongated rod 52 to remain secure even under the most severe shipping impacts. In this manner, the container 20 remains intact under strenuous conditions, yet can be easily separated into first 25 and second 30 sections for use by the operator. It will appreciated that the rod detent 56 can also be located in the first section 25. In a preferred embodiment the elongated rod 52 is metal, but it will appreciated that other materials can be employed.

Figure 13:
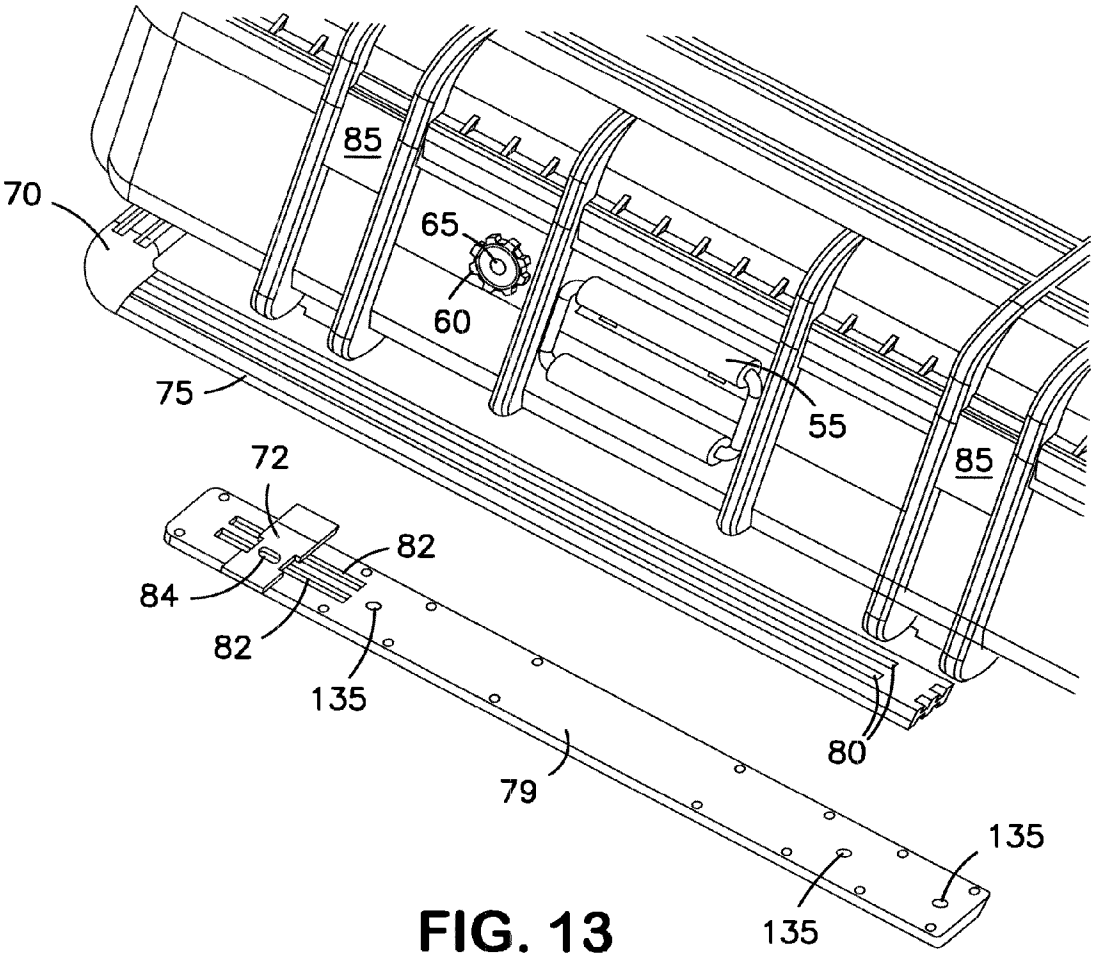
FIG. 13 is a perspective view of the container illustrated in FIG. 1 showing the extendable handle.

Referring now to FIGS. 3 and 13, a vent 60 is illustrated. Because the container 20 is airtight, conditions may arise where the pressure inside the container is less than the pressure outside the container and an operator will not be able to open the container 20 because of the pressure differential. For example, if the container 20 is filled with goods at a manufacturing facility located at 5,000 above sea level, then shipped to a receiving facility at sea level, a significant pressure differential will exist between the interior of the container 20 and the exterior of the container 20. In this situation it will be extremely difficult, if not impossible, to open the container 20 as a result of the higher pressure outside the container 20 relative to the lower pressure inside the container 20. One advantage of the present invention is that it contains a vent screw 60 that threads into a vent hole 65. When a pressure difference exists, the vent screw 60 is threaded out of the vent hole 65 and air is permitted to enter the interior of the container 20 thereby equalizing air pressure between the inside of the container 20 and the outside of the container 20. It will appreciated that the vent screw 60 can also be a non-threaded device that permits the equalization of pressures between the inside and outside of the container 20.

Another advantage of the present invention embodied in container 20 are the devices that permit easy transportation of the container 20. For example, handles 55, illustrated throughout the Figures, are positioned on all sides of the container 20 except for the hinge side 40. It will be appreciated that the handles 55 can be positioned only on one side, or on all sides including hinge side 40. Illustrated in FIG. 5, handle 55 is spring-actuated and remains positioned adjacent to the side of the container 20. Ribs 45 project past the handle 55 protecting the handle from impacts. In addition, illustrated in FIGS. 2 and 3, wheels 125 are located on the second section 30 of the container 20 enabling operators to pull or push the container 20. Wheels 125 are mounted in the second section 30 without the use of bearings. Therefore, the wheels 125 cannot be fouled by sand or dirt. Pins (not shown) located in ribs 45 position the wheels 125 in the second section 30.

Figure 14:
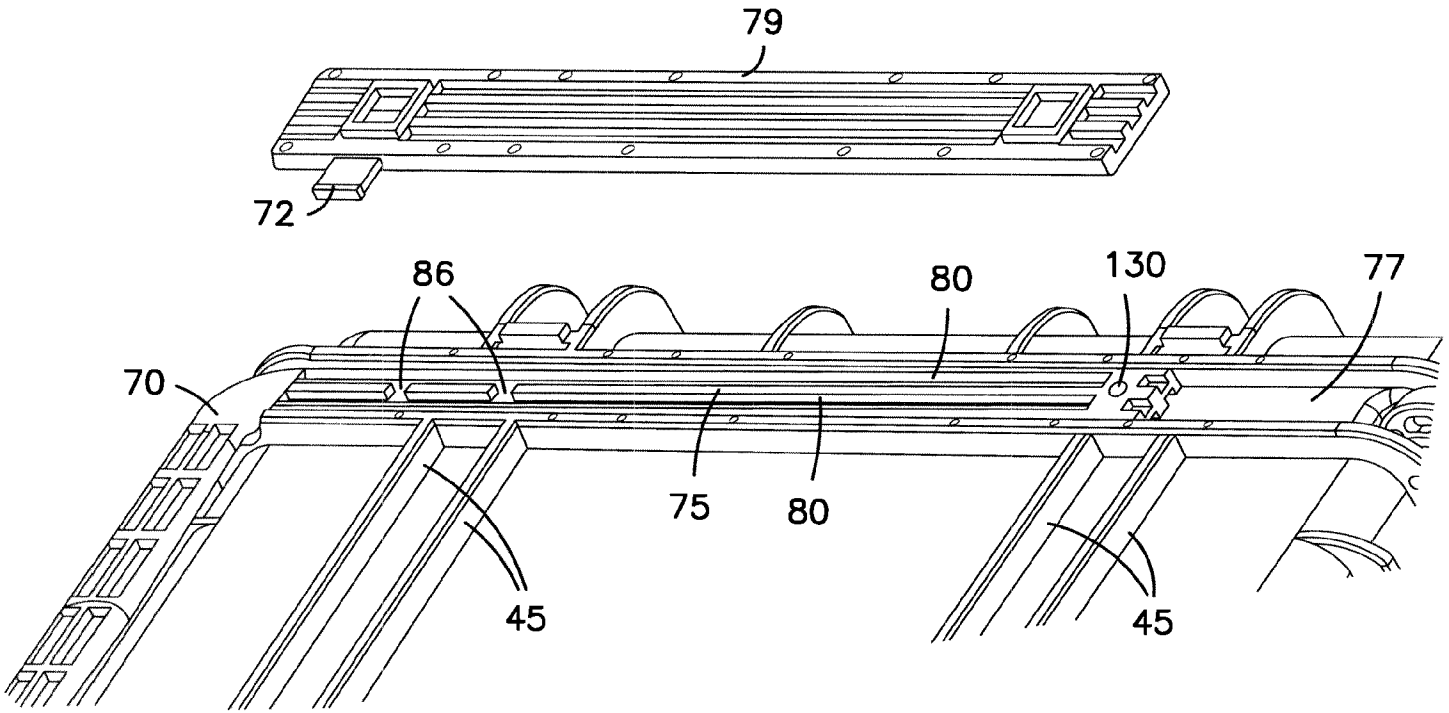
FIG. 14 is a perspective view of the extendable handle illustrated in FIG. 13.
Figure 15:
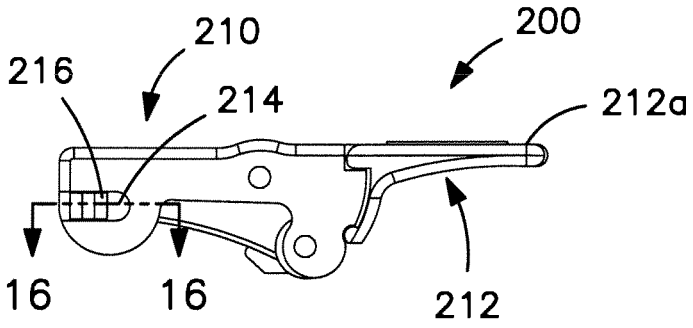
FIG. 15 is a side view of another embodiment of a latch used to secure a container.
Figure 16:
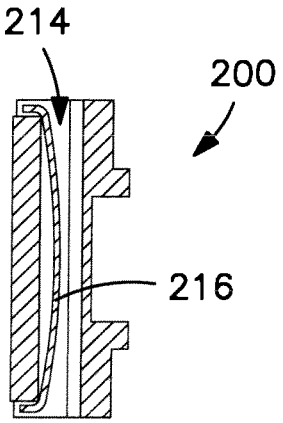
FIG. 16 is a partial cross-sectional view of the latch of FIG. 15 taken along 16-16 of FIG. 15.
Figure 17:
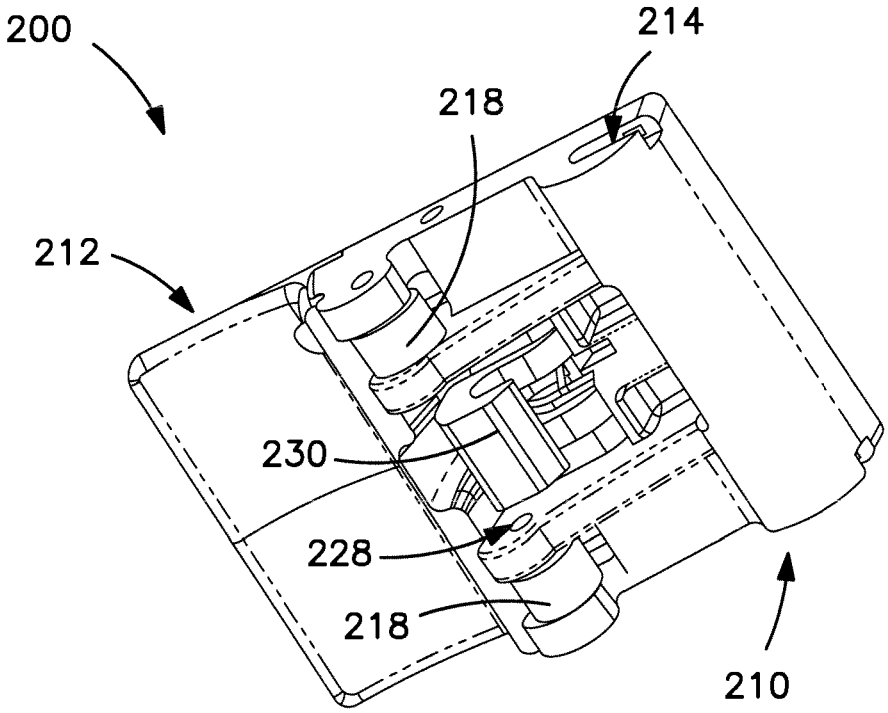
FIG. 17 is a perspective view of the latch illustrated in FIG. 15.
Figure 18:
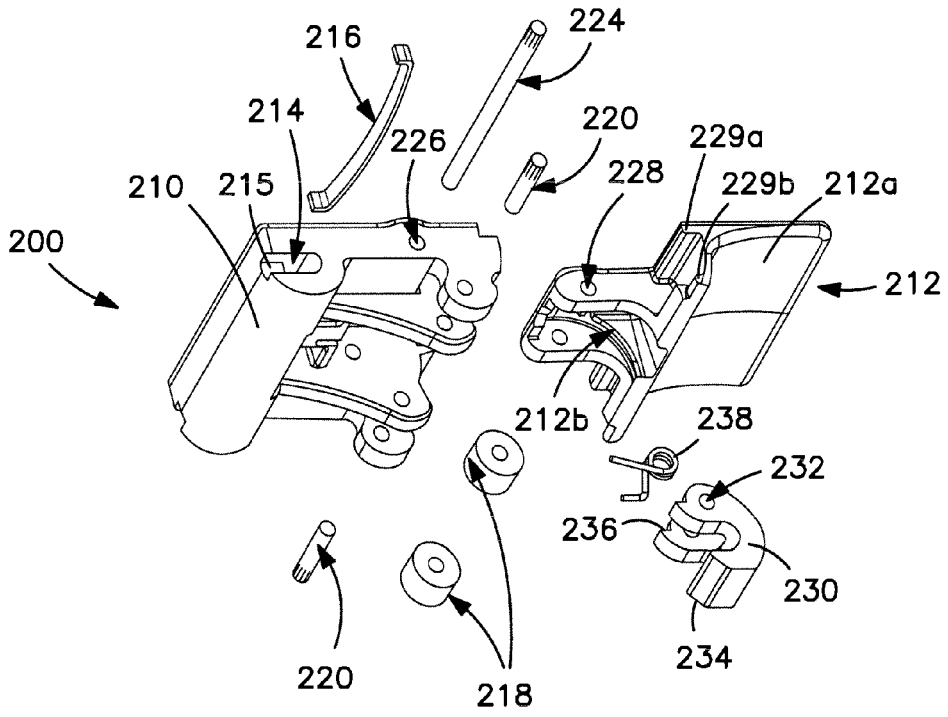
FIG. 18 is an exploded view of the latch illustrated in FIG. 15.

Referring now to FIGS. 2, 13 and 14, an extendable handle 70 constructed in accordance with the present invention is illustrated. Extendable handle 70 is located in the second section 30 of the container, and includes handle legs 75 that are positioned in exterior channels 77. In this manner, the container 20 remains environmentally sealed because the handle 70 does not enter the interior of the container 20. Handle covers 79 fasten to the second section 30 and locate the extendable handle 70 in the exterior channels 77. When desired, extendable handle 70 is deployed by an operator by pulling on the extendable handle 70 and releasing sliding lock 72. Shown in FIG. 13, sliding lock 72 includes a projection 84 that can be positioned by the sliding lock 72 to either align with slot guides 82 or be positioned between slot guides 82. Slot guides 82 fit into slots 80 in extendable handle legs 75. As the legs 75 slide in the slot guides 82, the projection 84 can be positioned between slot guides 82 so that the legs are fixed in a retracted position maintaining the handle 70 in this desired position. In a preferred embodiment, the handle 70 can be fixed in an extended position by engaging the projection 84 into a projection receiver 86. However, it will be appreciated that the number of projection receivers 86 can be varied to adjust the extendable height of the handle 70.

Also shown in FIGS. 13-14 a spring-mounted sphere 130 is positioned near a bottom section of the handle legs 75. In one embodiment, the sphere is a metal ball, but it will be appreciated that a pin or other deflectable member could be positioned in the bottom area of the handle leg 75. The spring-mounted sphere 130 is sized to be received into the sphere receivers 135 located in handle covers 79. The spring-mounted sphere extends into the sphere receivers 135 locking the leg 75 in either a stored position or in an extended position.

Referring now to FIGS. 15-19, a latch according to another embodiment of the invention is illustrated. The latch 200 includes an upper body 210 and a lower body 212. The lower body is adapted to swivel relative to the upper body about a connecting pin 224 which attaches the upper body 210 to the lower body 212. The upper body 210 and the lower body 212 may be formed of a variety of materials, including various plastics which may be molded.

The upper body 210 is provided with a cylindrical cavity 214 adapted to accommodate a latch pin and a deflectable member. In the embodiment of the latch illustrated in FIGS. 15-19, the deflectable member is a leaf spring 216. The leaf spring 216 is preferably formed of a metal. As described below, the leaf spring forms a resilient deflectable member which accommodates relative compression movement between two sections of a container.

Figure 19:
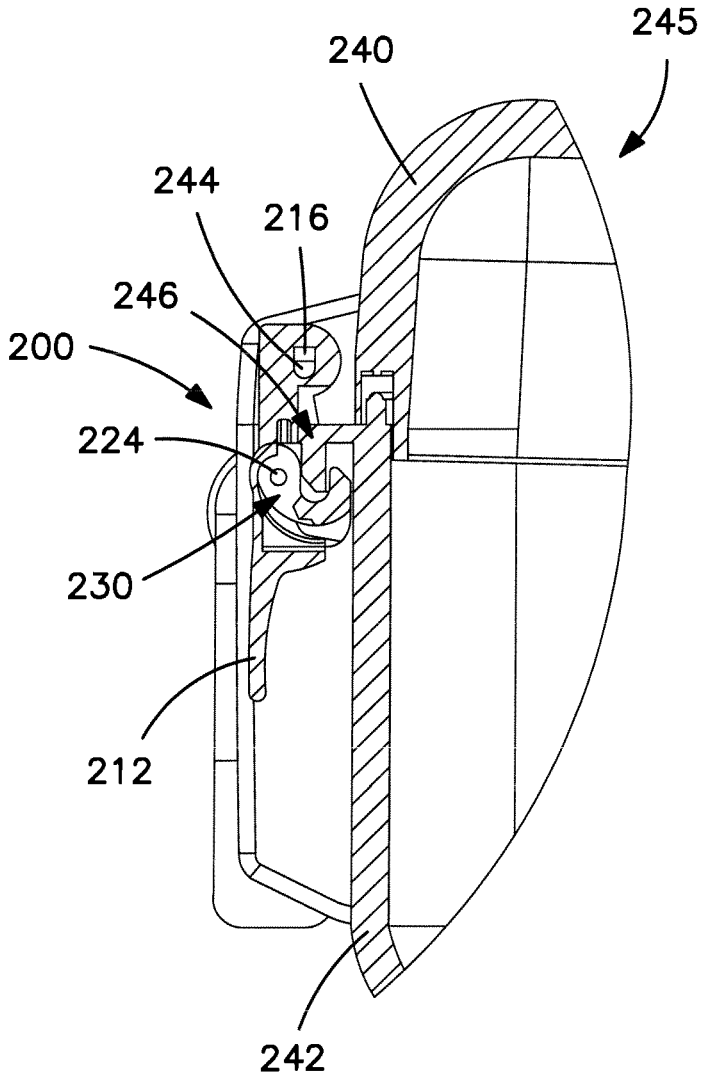
FIG. 19 is a side view of the latch of FIG. 15 attached to a container.

The leaf spring 216 can be positioned within the cylindrical cavity 214 where it is retained by positioning the leaf spring 216 into notches 215 formed at each end of the cylindrical cavity 214. The positioning of the leaf spring 216 is such that the central portion of the leaf spring 216 bows toward the latch pin 244 and either toward or away from the lower body 212 of the latch 200. In the embodiment illustrated in FIGS. 15-19, the leaf spring 216 bows toward the lower body 212 and is positioned on the side of the latch pin 244 away from the lower body 212 when the latch 200 is installed on a container 245, as shown in FIG. 19. When installed on a container 245, a latch pin 244 (FIG. 19) is positioned through the cylindrical cavity 214 adjacent to the leaf spring 216 and connects the latch 200 to a first section 240 of the container 245.

The upper body 210 of the latch 200 is provided with rollers 218 that are secured to the upper body 210 with roller pins 210. The rollers 218 are adapted to freely rotate about he roller pins and facilitate latching and unlatching of the latch 200 to the container 245.

As noted above, the lower body 212 is connected to the upper body 210 by the connecting pin 224. Through holes 226 are provided in the upper body to accommodate the connecting pin 224, which is also passed through corresponding through holes 228 in the lower body 212. In this regard, the lower body 212 is pivotally connected to the upper body 210. The lower body 212 is provided with stops 229*a*, 229*b* to limit the range of pivoting of the lower body 212 relative to the upper body 210.

The lower body 212 is provided with a grip portion 212*a* which allows a user to manipulate the latch. The lower body 212 is also provided with a latch hook housing 212*b* to accommodate a latch hook 230. The latch hook 230 is provided with through holes 232 through which the connecting pin 224 passes to secure the latch hook to the lower body 212 and the upper body 210. A coil spring 238 is positioned between the through holes 232 to bias a latching portion 234 of the latch hook 230 away from the surface of the lower body 212. The latch hook 230 is also provided with a rotational stop 236 which limits the rotation of the latch hook due to the coil spring 238.

Referring now to FIG. 19, the latch 200 is shown in conjunction with a first section 240 and a second section 242 of the container 245. As described above, the latch 200 is connected to the first portion 240 of the container 245 by way of a latch pin 244 which is passed through the cylindrical cavity 214 of the upper body 210 of the latch 200. The latch pin 244 is adjacent to the leaf spring 216 positioned within the cylindrical cavity 214. The leaf spring 216 is positioned such that it bows toward the latch pin 244.

The second section 242 of the container 245 is provided with a latch hook receptacle 246 adapted to receive the latching portion 234 of the latch hook 230. When the container 245 is latched, the latching portion 234 of the latch hook 230 engages the latch hook receptacle 246 to secure the first section 240 of the container 245 to the second section 242.

When the latch 200 is in the latched configuration, as shown in FIG. 19, the leaf spring 216 is able to accommodate relative compression movement between the first section 240 of the container 245 and the second section 242 of the container 245. The resilient bowed configuration of the leaf spring 216 absorbs the relative compression movement and prevents unintended opening of the latch.

Further, the latch hook 230 is spring loaded with the coil spring 238. When the container 245 suffers an impact, the spring-loaded latch hook 230 is biased toward the latch hook receptacle 246 to maintain a secure latch. Thus, the container 245 is provided with additional resistance to inadvertent opening.

When a user desires to open the container 245, the user may grasp the grip portion 212*a* of the lower body 212 of the latch 200 and pull the grip portion 212*a* away from the container 245. The pulling of the grip portion 212*a* causes pivoting of the lower body 212 relative to the upper body 210. The pivoting of the lower body 212 allows the latch hook 230 to rotate out of the latch hook receptacle 246, allowing the container 245 to be opened.

One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. A latch system for a container, the container including a first section and a second section, the latch system comprising:

a latch pin mounted in the first section; and a deflectable member mounted in a latch, with the latch pivotally coupled to the latch pin; and wherein the latch is structured to removably engage the second section, and the deflectable member is a leaf spring configured to absorb relative compression movement between the first section and the second section.

2. The latch system of claim 1, wherein the leaf spring is positioned adjacent to the latch pin within a substantially cylindrical cavity of the latch.

3. The latch system of claim 2, wherein the leaf spring is configured to bow toward the latch pin.

4. The latch system of claim 1, wherein the deflectable member is configured to absorb relative compression movement between the first section and the second section by absorbing relative movement between the latch pin and the latch.

5. The latch system of claim 1, wherein the leaf spring is formed of a metal.

6. A container including a first section and a second section, the container comprising:

deflectable latch means for releaseably coupling the first section to the second section and for absorbing relative compression movement between the first and second sections when the first and second sections are coupled together, wherein the deflectable latch means comprises:

a latch pin mounted in the first section; and a deflectable member mounted in a latch, with the latch pivotally coupled to the latch pin; and wherein the latch is structured to removably engage the second section, and the deflectable member is a leaf spring configured to absorb relative compression movement between the first section and the second section.

7. The container of claim 6, wherein the leaf spring is positioned adjacent to the latch pin within a substantially cylindrical cavity of the latch.

8. The container of claim 7, wherein the leaf spring is configured to bow toward the latch pin.

9. The container of claim 6, wherein the deflectable member is configured to absorb relative compression movement between the first section and the second section by absorbing relative movement between the latch pin and the latch.

10. The container of claim 6, wherein the leaf spring is formed of a metal.

* * * * *